US005427709A

United States Patent [19]

Antin et al.

[11] Patent Number: 5,427,709

[45] Date of Patent: Jun. 27, 1995

[54] ENVIRONMENTALLY SAFE, READY-TO-USE, NON-TOXIC, NON-FLAMMABLE, INORGANIC, AQUEOUS CLEANING COMPOSITION

[75] Inventors: Neil E. Antin, Germantown, Md.; Douglas P. Jackson, Rockaway, N.J.

[73] Assignee: The United States of America as represented by the Secretary of the Navy, Washington, D.C.

[21] Appl. No.: 181,504

[22] Filed: Jan. 14, 1994

[51] Int. Cl.[6] ..... C11D 7/14; C11D 7/60; C11D 7/10

[52] U.S. Cl. ..... 252/135; 252/173; 252/315.5; 252/181; 252/387; 423/279; 423/280

[58] Field of Search ..... 252/174.25, 389.4, 389.3, 252/389.54, 389.62, 135, 140, 159, 173, 315.5, 181, 87, 387; 134/42; 423/279, 280

[56] References Cited

U.S. PATENT DOCUMENTS

| | | | |
|---|---|---|---|
| 3,881,998 | 5/1975 | Miyosawa | 205/106 |
| 4,097,287 | 6/1978 | Ito et al. | 252/8.1 X |
| 4,105,511 | 8/1978 | Nikaido et al. | 205/50 |
| 4,138,353 | 2/1979 | Lipinski | 252/181 |
| 4,362,644 | 12/1982 | Davis et al. | 252/389.31 |
| 4,402,847 | 9/1983 | Wilson et al. | 252/181 X |
| 4,532,047 | 7/1985 | Dubin | 252/181 X |
| 4,584,104 | 4/1986 | Dubin | 252/181 X |
| 4,772,408 | 9/1988 | Mohr et al. | 252/75 |
| 5,118,434 | 6/1992 | Meyer et al. | 252/70 |

FOREIGN PATENT DOCUMENTS

| | | | |
|---|---|---|---|
| 0323680 | 7/1989 | European Pat. Off. | 252/181 |

OTHER PUBLICATIONS

*1986–1987 Alfa Catalog*, Morton Thiokol, Inc., 1986, pp. 484 and 522.

*Primary Examiner*—Paul Lieberman
*Assistant Examiner*—Douglas J. McGinty
*Attorney, Agent, or Firm*—William C. Townsend; Edward J. Connors, Jr.

[57] ABSTRACT

A cleaning composition, method of manufacture and method of cleaning of for use in cleaning equipment including life support equipment employed in the generating, handling, storage and delivery of oxygen-enriched gases and liquids are provided in which the cleaning composition is inorganic, non-flammable, non-toxic, environmentally safe, non-corrosive, and ready to use and which includes an aqueous silicate solution together with fluoroborates and molybdates.

11 Claims, No Drawings

ENVIRONMENTALLY SAFE, READY-TO-USE, NON-TOXIC, NON-FLAMMABLE, INORGANIC, AQUEOUS CLEANING COMPOSITION

BACKGROUND OF THE INVENTION

This invention relates to cleaning compositions and more particularly to those compositions, hereinafter referred to as oxygen cleaning agents, which are employed in cleaning the surfaces of oxygen or oxygen-enriched liquid and gas generating, handling, transport and storage equipment used for life support, propulsion, and other functions and the parts and assemblies thereof, such as hoses, pipes, valves, tanks, flasks, connectors, pumps, regulators, face masks and the like. The invention also includes a method of manufacturing the cleaning composition and a method of cleaning using the cleaning composition.

The standards of the Department of Defense (DOD), National Aeronautical and Space Administration (NASA), National Fire Protection Agency (NFPA), American Society of Testing and Materials (ASTM) and Society of Automotive Engineers (SAE) all specify that the rigorous removal of organic and particulate contamination from oxygen and oxygen enriched handling equipment is absolutely necessary to prevent a fire hazard. Failure to thoroughly clean oxygen and oxygen enriched handling equipment will and has resulted in catastrophic fires. The DOD, NASA, NFPA, ASTM and SAE all have records of equipment damage and personnel injuries and death from fires caused by the failure to adequately clean oxygen and oxygen enriched handling equipment. Testing by NASA has demonstrated that, in the presence of an ignition source caused by the presence of particulate contamination or organic material, many metals will burn in an oxygen atmosphere; and that the rate of burning will be extremely fast. For example, ASTM document G94-88, "Standard Guide for Evaluating Metals for Oxygen Service" reports 6061 aluminum in 100% oxygen at 276 bars burned at an average propagation rate of 13.86 centimeters per second and 316 stainless steel in 100% oxygen at 276 bars burned at an average propagation rate of 1.24 centimeters per second. NASA has high-speed video footage of a 690 bars rated valve operating with 276 bars gaseous oxygen as it fails due to particulate contamination. The conflagration penetrated and expanded beyond a 7.62 centimeter thick stainless steel valve in 0.25 seconds. Accompanying the fire hazard is a toxicity hazard associated with oxygen and oxygen-enriched handling equipment used in providing life support functions. The organizations previously referred to all have reports of personnel injury and death from toxic residue remaining in life-support equipment that was cleaned with a cleaning agent which was inadequate, either because it failed to remove toxic contaminants or because it contained toxic contaminants itself. As an example, the use of chlorinated hydrocarbon solvents is prohibited in underwater diving life support equipment because these compounds dechlorinate in carbon dioxide scrubbers, forming highly toxic and flammable dichloroacetylene.

The requirements for oxygen cleaning agents include the capability of removing common hydrocarbon soils such as lubricating oils and greases, since the presence of these soils represents an extreme fire hazard. Further, oxygen cleaning agents must be capable of removing particulate contamination, since the presence of excessive particulate contamination provides a potential ignition source in oxygen and oxygen-enriched handling equipment. Further, oxygen cleaning agents must be capable of removing halogenated lubricants approved for use with oxygen storage and delivery equipment. Although halogenated lubricants are used in oxygen-enriched handling equipment because they are not flammable, the failure to remove these lubricants during cleaning provides a mechanism for trapping particulate and/or hydrocarbon contamination. Further, the oxygen cleaning agent itself must be non-flammable in a gaseous or liquid oxygen environment so as not to present a fire hazard in the event the cleaner is not completely removed. Further, the oxygen cleaning agent itself must be either non-toxic or of an acceptable low level of toxicity as determined by a medical evaluation (such as trichlorotrifluoroethane solvent (also identified as CFC-113)) in the event the cleaner is not completely removed during the cleaning process. Further, the oxygen cleaning agent must be capable of being analyzed for residual total hydrocarbon contamination with a sensitivity of at least 1 part per million (ppm) to permit accurate, certifiable verification of hydrocarbon cleanliness. Finally, Department of Defense (DOD), National Aeronautical and Space Administration (NASA), and various commercial standards require oxygen-enriched handling equipment to be certified hydrocarbon clean. The DOD standard (MIL-STD-1330C) certifies hydrocarbon cleanliness when the effluent cleaning agent, that is, the cleaning agent following its use in cleaning the oxygen enriched handling equipment, measures less than 5 ppm total hydrocarbon contamination. A conversion factor is applied to convert the DOD standard to the NASA hydrocarbon cleanliness standard of 1 milligram per square foot.

The two principal existing oxygen cleaning agents are trichlorotrifluoroethane solvent (also identified as CFC-113) and tribasic sodium phosphate solution (also identified as TSP). CFC-113 is an ozone depleting substance, and a replacement will become necessary because its production is banned after Dec. 31, 1995. TSP has the disadvantage that it is a hazardous environmental waste. Further, TSP is corrosive to amphoteric metals such as aluminum. Further, TSP is of marginal effectiveness in removing the halogenated lubricants which can trap particulate and hydrocarbon contaminants. Further, TSP must be applied at relatively high temperatures in the range of 71.1° C. to 87.8° C. Further, at temperatures below the above-noted range, TSP precipitates leaving harmful deposits. Further, TSP leaves a phosphate layer on the surface being cleaned which may deleteriously affect the finish (smoothness) of that surface even after rinsing with water. Finally, the use of TSP as a cleaner requires extensive rinsing to prevent the formation of hard phosphate residues which are not readily soluble in water and which are detrimental to critical components.

In addition, there are numerous aqueous or solvent based biodegradable cleaners available which claim to have oxygen system cleaning capabilities. However, these cleaners contain hydrocarbon derivative components (such as organic surfactants) and thus have the disadvantages associated with hydrocarbons previously noted. Specifically, they have the fire hazard associated therewith, a potential toxicity hazard in life-support systems and an inability to analyze the effluent cleaning agent for residual total hydrocarbon contamination with a sensitivity of at least 1 part per million (ppm) to permit accurate, certifiable verification of hydrocarbon cleanliness. Finally, alternate chlorinated solvents such as perchloroethylene and methylene chloride are unusable in any life-support equipment because these solvents are highly toxic, having been identified as suspected human carcinogens.

DETAILED DESCRIPTION OF THE PREFERRED EMBODIMENTS

The preferred oxygen cleaning agent according to this invention is an aqueous inorganic solution comprising silicon dioxide ($SiO_2$) and an inorganic oxide compound ($X_2O$) at a $SiO_2$:$X_2O$ mole ratio in the range of 1.8 to 2.2 with a polysilicate anion concentration in the range of 2 to 18% by weight; an inorganic fluoroborate compound ($XBF_4$) in the range of 0.01 to 1.0% by weight; an inorganic molybdate compound $X_2MoO_4$ in the range of 0.01 to 1.0% by weight and the balance by weight demineralized water wherein X is a member of the group consisting of sodium and potassium. The pH of the final aqueous solution is 11.5 to 12.0. The purity of each constituent previously described must be such that the final cleaner composition meets the following requirements: the visual clarity shall be clear with no visible contamination, the total carbon contamination (including hydrocarbons minus any carbon present as carbon dioxide) shall not exceed 1.0 ppm, the total insoluble matter shall not exceed 0.5 ppm, and the total chloride contamination shall not exceed 2.0 ppm. The preferred elements, ranges and pH for optimum performance are as follows: a $Si_2O$:$X_2O$ mole ratio in the range of 1.8 to 1.9; a polysilicate anion concentration in the range of 9.0 to 10% by weight; an inorganic fluoroborate compound ($XBF_4$) in the range of 0.4 to 0.6% by weight; an inorganic molybdate compound $X_2MoO_4$ in the range of 0.4 to 0.6% by weight and the pH of the final aqueous solution in the range of 11.9 to 12.0; where X is either sodium or potassium.

In an alternate form of the invention, the resulting cleaning agent can also be supplied with organic surface wetting agents (surfactants) such as the fluorosurfactants "Zonyl", manufactured by Dupont Company, to enhance the removal of thick soil deposits. However, this form of the cleaning agent will not be acceptable for final cleaning of oxygen enriched handling equipment for the reasons previously noted. Specifically, the presence of organic surfactants has an associated potential fire and toxicity hazard and results in inability to analyze the effluent cleaning agent for residual total hydrocarbon contamination with a sensitivity of at least 1 part per million (ppm) to permit accurate, certifiable verification of hydrocarbon cleanliness.

It should be noted that the X component referred to previously could be chosen from a group also including: ammonium, barium, beryllium, calcium, cesium, lithium, magnesium, rubidium and strontium. However, while the compound resulting from such additional possibilities would be inorganic and might have acceptable cleaning performance, the resulting toxicity, reduction of corrosion inhibition, and difficulty in rinsing would severely limit the use of the cleaner, making it impractical in practice. The preferred oxygen cleaning agent previously described according to this invention is manufactured as follows: reagent grade silicic acid ($SiO_3H_2$) and one of the reagent grade inorganic alkaline compounds sodium hydroxide (NaOH) or potassium hydroxide (KOH) are reacted at high temperature to form a high purity highly concentrated silicate solution. A predetermined quantity of this solution is mixed with demineralized water ($H_2O$) meeting the requirements of ASTM D1193 Type 1 to obtain a silicate solution having a $SiO_2$:$X_2O$ mole ratio of 1.8 to 2.2 with a polysilicate anion concentration of 2 to 18% by weight and pH of 12.0 to 12.7 wherein X is a member of the group consisting of sodium and potassium. Alternatively, a commercially available silicate solution having a $SiO_2$:$X_2O$ mole ratio of 1.8 to 2.2 with a polysilicate anion concentration of 2 to 18% by weight and pH of 12.0 to 12.7 wherein X is a member of the group consisting of sodium and potassium can be used as the starting point. The silicate solution is heated, in situ, to a temperature in the range 76.7° C. to 82.2° C. and maintained at this temperature for not less than 1 hour. The solution is filtered in steps with 50 micron, 10 micron and 3 micron filters to remove insoluble matter. One of the reagent grade inorganic molybdate compounds sodium molybdate ($Na_2MoO_4$) or potassium molybdate ($KM_2oO_4$) is added in the range of 0.01 to 1.0% by weight to provide corrosion inhibition. Reagent grade fluoroboric acid ($HBF_4$) is added for corrosion inhibition by reducing the pH value of the cleaning agent to the range of 11.5 to 12.0, and by forming, in situ, one of the following: sodium fluoroborate ($NaBF_4$) or potassium fluoroborate ($KBF_4$) in the range of 0.01 to 1.0% by weight. Reagent grade sodium hydroxide (NaOH) or potassium hydroxide (KOH) is added to the final solution in an amount sufficient to adjust the final $SiO_2$:$X_2O$ mole ratio to the range of 1.8 to 2.2 with a polysilicate anion concentration of 2 to 18% by weight. Finally, during the manufacturing process, the purity of each constituent previously described must be such that the final cleaner composition meets the following requirements: the visual clarity shall be clear with no visible contamination, the total carbon contamination (including hydrocarbons minus carbon present as carbon dioxide) shall not exceed 1.0 ppm; the total insoluble matter shall not exceed 0.5 ppm, and the total chloride contamination shall not exceed 2.0 ppm. The preferred ranges and pH for optimum performance are as follows: a $SiO_2$:$X_2O$ mole ratio in the range of 1.8 to 1.9; a polysilicate anion concentration in the range of 9.0 to 10% by weight; an inorganic fluoroborate compound ($XBF_4$) in the range of 0.4 to 0.6% by weight; an inorganic molybdate compound ($X_2MoO_4$) in the range of 0.4 to 0.6% by weight and the pH of the final aqueous solution in the range of 11.9 to 12.0, wherein X is a member of the group consisting of sodium and potassium.

EXAMPLE I: Oxygen cleaning agent according to the invention was made as follows: a highly concentrated sodium silicate solution was prepared by reacting 45.4 kilograms of 99.9% silicic acid with 93.0 kilograms of 50% sodium hydroxide solution at 104.4° C. to 126.7° C. This temperature was maintained for four hours under reflux conditions not allowing the temperature to exceed 126.7° C. This material was then quenched with 68.0 kilograms of ASTM D1193 Type 1 demineralized water. Two hundred and twenty five grams of this 44% active polysilicate anion sodium silicate solution was mixed with one liter of ASTM D1193 Type 1 demineralized water to obtain a silicon dioxide:disodium oxide mole ratio of 1.83, a polysilicate anion concentration of 9.5% by weight and a pH of 12.4. This solution was then heated to 82.2° C. for two hours and filtered in steps through 50 micron, 10 micron and 3 micron filters. The solution was allowed to cool to room temperature, and five grams of 99.9% sodium molybdate was added as a corrosion inhibitor. Then 15 grams of 48 to 50% fluoroboric acid was added as an additional corrosion inhibitor reducing the pH to 11.93 and forming in situ sodium fluoroborate.

EXAMPLE II: Preparation of the oxygen cleaning agent would be the same as in EXAMPLE I except that potassium would be substituted for sodium.

The cleaning agent of this invention cleans oils, greases, fats, including halogenated oils and greases, and particulate matter from metallic, rubber and plastic surfaces when applied hot at temperatures of from 37.8° C. to 93.3° C. The cleaning agent can be used as a pumped pipe-line cleaner, batch tank cleaner, spray impingement cleaner, steam cleaner and ultrasonic tank cleaner. The cleaner, being an alkaline solution, will remove common organic fat based soils by emulsification or solubilization. The cleaner removes the more difficult industrial based hydrocarbons and halogenated mineral oil and mineral grease soils from a surface by displacement. The principle displacing agent is the polysilicate anion. At the $SiO_2$:$X_2O$ mole ratio in the range of 1.8 to 2.2, these polysilicate anions exist as charged cyclic silicate molecules. These structures include the more numerous $[Si_3O_9]^{n-}$ molecules and less numerous $[Si_4O_{12}]^{n-}$ molecules with charges of -6 and -8 respectively. At the 2 to 18% by weight polysilicate anion concentration, the charged cyclic silicate molecules develop electrostatic forces that displace and disperse the soil from the substrate while depositing an inorganic amorphous glass surface. The inorganic amorphous glass surface prevents redeposition of the soil and is easily hydrated and removed by rinsing with water. The electrostatic forces and subsequent displacement ability previously described are not inherent with the more commonly used orthosilicate and disilicate species because these molecules share all the oxygen resulting in no net electrical charge yielding a poor cleaner, but good alkaline builder.

EXAMPLE III: Soil removal performance of oxygen cleaning agent as described in EXAMPLE I was as follows: a MONEL (NiCu) metallic sample of dimensions 2.54 centimeter by 5.08 centimeter by 0,635 centimeter thick was coated with military specification MIL-L-17331 hydrocarbon mineral oil at a concentration of 15.5 milligrams per square centimeter and allowed to soak fully immersed in 100 milliliters of oxygen cleaning agent at 71.1° C. for 30 minutes with no agitation. The oxygen cleaning agent removed 95.9% of the oil; a MONEL (NiCu) metallic sample of dimensions 2.54 centimeter by 5.08 centimeter by 0.635 centimeter thick was coated with federal specification A-A-50433 hydrocarbon mineral grease at a concentration of 15.5 milligrams per square centimeter and allowed to soak fully immersed in 100 milliliters of oxygen cleaning agent at 71.1° C. for 30 minutes with no agitation. The oxygen cleaning agent removed 92.7% of the grease; a MONEL (NiCu) metallic sample of dimensions 2.54 centimeter by 5.08 centimeter by 0,635 centimeter thick was coated with military specification DOD-L-24574 Halocarbon Products HP4.2S halogenated oil at a concentration of 15.5 milligrams per square centimeter and allowed to soak fully immersed in 100 milliliters of oxygen cleaning agent at 71.1° C. for 30 minutes with no agitation. The oxygen cleaning agent removed 99.9% of the oil; a MONEL (NiCu) metallic coupon of dimensions 2.54 centimeter by 5.08 centimeter by 0.635 centimeter thick was coated with military specification MIL-G-47219 Halocarbon Products HP25-5S halogenated grease at a concentration of 15.5 milligrams per square centimeter and allowed to soak fully immersed in 100 milliliters of oxygen cleaning agent at 71.1° C. for 30 minutes with no agitation. The oxygen cleaning agent removed 100.0% of the grease.

Other advantages of the oxygen cleaning agent of this invention are described as follows: it is non-flammable; is non-toxic; contains no environmentally hazardous material; is compatible with non-metallic material; is easily rinsed leaving no residue; does not separate when subjected to freeze-thaw or boiling; does not produce a stable foam which would affect its use as a pump line or spray cleaner; and is capable of being analyzed by various techniques for residual total hydrocarbon contamination with a sensitivity of at least 1 part per million (ppm) to permit accurate, certifiable verification of hydrocarbon cleanliness. The analysis techniques include solvent extraction with subsequent infrared analysis, solvent extraction with subsequent gravimetric analysis of non-volatile residue, total carbon analysis of the cleaner directly, and ultraviolet analysis of the cleaner directly. These analysis techniques are possible because of the very low organic content (less than 1.0 ppm) and optical clarity (maximum insoluble matter of 0.5 ppm and filtered through 3 micron filters) of the cleaner of this invention in comparison to other cleaners. Silicate solutions with $SiO_2$:$X_2O$ mole ratios (wherein X is either sodium or potassium) of less than or equal to 2.0 do not show any evidence of aggregating into micron or sub-micron sized colloidal particles. Therefore, the turbidity (measure of reflected light) of the cleaning agent is very low in comparison to other cleaners. The resulting advantage is the ability to quickly and easily evaluate the presence of extremely low levels of organic and inorganic contaminates which will exist in the cleaner as colloidal particles by the change in reflected light. As the $SiO_2$:$X_2O$ mole ratio increases above 2.0, turbidity increases as some aggregation occurs, effecting the ability to detect extremely low levels of organic and inorganic contaminates. Finally, the cleaning agent exhibits excellent corrosion resistance on metallic materials. Although silicate solutions are reputed to have inherent corrosion resistance characteristics, testing with amphoteric metals indicated otherwise. Specifically, aluminum alloys 5052, 5456, and 6061, all of which are constituent metals of aviation oxygen systems, demonstrated rapid corrosive attack by silicate alkaline solutions. This is corrected by the addition of the inorganic and environmentally safe molybdate and fluoroborate compounds. The corrosion inhibiting characteristics of molybdate compounds and fluoroborate compounds combine to produce a synergistic corrosion inhibitor system greater than the sum of the individual molybdate and fluoroborate compounds.

EXAMPLE IV: The aluminum corrosion resistance performance of the oxygen cleaning agent described in EXAMPLE I is as follows: three alloy 5052 aluminum coupons, each having a total surface area of 31 square centimeters were immersed for 24 hours in the oxygen cleaning agent at 76.7° C. The resultant weight loss was between 0.032 and 0.065 milligrams per square centimeter with no visual evidence of corrosion or staining; three alloy 5456 aluminum coupons, each having a total surface area of 38 square centimeters were immersed for 24 hours in the oxygen cleaning agent at 76.7° C. The resultant weight loss was between 0.053 and 0.105 milligrams per square centimeter with no visual evidence of corrosion or staining; and three alloy 6061 aluminum coupons, each having a total surface area of 41 square centimeters were immersed for 24 hours in the oxygen cleaning agent at 76.7° C. The resultant weight loss was 0.000 milligrams per square centimeter with no visual evidence of corrosion or staining.

We claim:

1. A cleaning composition comprising a silicate solution of $SiO_2$ and $X_2O$ in a $SiO_2$:$X_2O$ mole ratio in the range of 1.8 to 2.2 with a polysilicate anion concentration in the range of 2 to 18% by weight, a corrosion inhibitor material selected from the group consisting of $XBF_4$ with a weight concentration in the range of 0.01 to 1.0% and $X_2MoO_4$ with a weight concentration in the range of 0.01 to 1.0% and mixtures thereof and the balance demineralized water wherein X is chosen from the group consisting of sodium and potassium.

2. A cleaning composition as set forth in claim 1 wherein the corrosion inhibitor material includes $XBF_4$.

3. A cleaning composition as set forth in claim 1 wherein the corrosion inhibitor material further includes $XM_{2o}O_4$.

4. A cleaning composition as set forth in claim 1 and further including an organic surface wetting agent to improve the removal of thick soil deposits.

5. A cleaning composition as set forth in claim 1 wherein the total chloride contamination of the cleaning composition is less than 2.0 ppm and the total insoluble matter contamination of the cleaning composition is less than 0.5 ppm.

6. A cleaning composition as set forth in claim 1 wherein the total carbon contamination, including hydrocarbons but excluding carbon dioxide, of the cleaning composition is less than 1.0 ppm.

7. A cleaning composition as set forth in claim 2 wherein the corrosion inhibitor material further includes $X_2MoO_4$.

8. A cleaning composition as set forth in claim 7 wherein the pH is in the range of 11.5 to 12.0.

9. A cleaning composition as set forth in claim 7 and further including an organic surface wetting agent to enhance the removal of thick soil deposits.

10. A cleaning composition as set forth in claim 7 wherein the visual clarity of the composition is clear with no visible contamination, the total chloride contamination of the cleaning composition is less than 2.0 ppm, the total carbon contamination, including hydrocarbons but excluding carbon dioxide, of the cleaning composition is less than 1.0 ppm, and the total insoluble matter contamination of the cleaning composition is less than 0.5 ppm.

11. A cleaning composition as set forth in claim 1 wherein the pH is in the range of 11.5 to 12.0 and further including an organic surface wetting agent to enhance the removal of thick soil deposits.

* * * * *

UNITED STATES PATENT AND TRADEMARK OFFICE

CERTIFICATE OF CORRECTION

PATENT NO. : 5,427,709

DATED : June 27, 1995

INVENTOR(S) : Neil Antin et al

It is certified that error appears in the above-indentified patent and that said Letters Patent is hereby corrected as shown below:

On the title page:

Item 73, after "D.C.", add --and Octagon Process, Inc., Rockaway, N.J.--.

Column 4, line 21, change "$KM_2oO_4$" to --$K_2MoO_4$--.

Column 5, line 43, change "0,635" to --0.635--.

Column 7

Claim 2, line 22, change "$XM_2oO_4$" to --$X_2MoO_4$--.

Signed and Sealed this

Twenty-eighth Day of November 1995

*Attest:*

Bruce Lehman

BRUCE LEHMAN

*Attesting Officer*

*Commissioner of Patents and Trademarks*